United States Patent [19]

Martinsons et al.

[11] 4,105,516

[45] Aug. 8, 1978

[54] METHOD OF ELECTROLYSIS

[75] Inventors: Aleksandrs Martinsons, Wadsworth; Harlan B. Johnson, Rittman, both of Ohio

[73] Assignee: PPG Industries, Inc., Pittsburgh, Pa.

[21] Appl. No.: 814,767

[22] Filed: Jul. 11, 1977

[51] Int. Cl.[2] ..... C25B 1/16; C25B 1/26; C25B 1/02

[52] U.S. Cl. ..... 204/98; 204/128; 204/129

[58] Field of Search ..... 204/98, 128, 129, 99, 204/251

[56] References Cited

U.S. PATENT DOCUMENTS

| | | | |
|---|---|---|---|
| 2,823,177 | 2/1958 | Osborne | 204/98 |
| 2,982,608 | 5/1961 | Clement | 204/98 |
| 3,124,520 | 3/1964 | Juda | 204/86 |
| 3,214,362 | 10/1965 | Juda | 204/98 |
| 3,630,863 | 12/1971 | Jeffery et al. | 204/98 |
| 3,756,930 | 9/1973 | Weiss et al. | 204/129 |
| 4,033,837 | 7/1977 | Kuo et al. | 204/98 |
| 4,040,932 | 8/1977 | Cotton | 204/251 |

OTHER PUBLICATIONS

Encyclopedia of Chem. Tech., 2nd Ed., Kirk-Othmer, 1967, p. 232.

*Primary Examiner*—R. L. Andrews
*Attorney, Agent, or Firm*—Richard M. Goldman

[57] ABSTRACT

Disclosed is a method of electrolyzing alkali metal chloride brines by passing an electrical current from an anode in an aqueous alkali metal chloride anolyte liquor through a permeable barrier to a cathode in an aqueous catholyte liquor, whereby to evolve chlorine at the anode and hydrogen at the cathode. Also disclosed is the addition of a compound of an electrolytic hydrogen evolution catalyzing transition metal to the catholyte liquor while passing electrical current from the anode to the cathode. The addition of the compound of the transition metal through the catholyte liquor causes a reduction in the cell voltage.

24 Claims, No Drawings

METHOD OF ELECTROLYSIS

DESCRIPTION OF THE INVENTION

In the process of electrolyzing an alkali metal chloride brine, such as an aqueous solution of sodium chloride or potassium chloride, to produce alkali metal hydroxide and chlorine, the alkali metal chloride solution is fed to the cell, a voltage is imposed across the cell, chlorine is evolved at the anode, alkali metal hydroxide is produced in the electrolyte in contact with the cathode, e.g., catholyte liquor, and hydrogen is evolved at the cathode.

The overall anode reaction is reported in the literature to be:

$$2Cl^- \rightarrow Cl_2 + 2e^-, \quad (1)$$

while the overall cathode reaction is reported in the literature to be:

$$2H_2O = 2e^- \rightarrow H_2 + 2OH^-. \quad (2)$$

The overall cathode reaction is reported to be a two-step reaction. The first step of the cathode reaction is reported to be:

$$H_2O + e^- \rightarrow H_{ads} + OH^-, \quad (3)$$

by which the monatomic hydrogen is adsorbed onto the surface of the cathode. In basic media, for example, the catholyte cell liquor of an alkali metal chloride diaphragm cell, the adsorbed hydrogen is reported to be desorbed according to one of two processes:

$$2H_{ads} \rightarrow H_2, \quad (4)$$

or $$H_{ads} + H_2O + e^- \rightarrow H_2 + OH^-. \quad (5)$$

The hydrogen desorption step, represented by reactions (4) and (5), is reported to be the hydrogen overvoltage determining step. That is, it is the rate controlling step and its activation energy corresponds to the cathodic hydrogen overvoltage. The hydrogen evolution potential for the overall reaction (2) is on the order of about 1.5 to 1.6 volt versus a saturated calomel electrode (SCE) on iron in basic media. Iron, as used herein to characterize the cathodes, includes iron and iron alloys, such as low carbon steels and alloys of iron with manganese, phosphorous, cobalt, nickel, molybdenum, chromium, vanadium, and the like.

According to the method disclosed herein, it has been found that the hydrogen overvoltage may be reduced, for example, by from about 0.1 volt to about 0.3 volt, i.e., to a cathode potential below about 1.3 volt, by adding a compound of an electrolyte hydrogen evolution catalyzing transition metal to the catholyte liquor while the cell is in operation.

DETAILED DESCRIPTION OF THE INVENTION

Disclosed is a method of electrolyzing aqueous alkali metal chlorides where an electrical potential is imposed across an anode and a cathode so that an electrical current passes from an anode of an electrolytic cell to a cathode of the cell. In this way, chlorine is evolved at the anode and hydrogen is evolved at the cathode. According to the disclosed method, a compound of an electrolytic hydrogen evolution catalyzing transition metal is added to the catholyte liquor and an electrical current is caused to pass from the anode of the electrolytic cell to the cathode of the electrolytic cell.

Also disclosed is a method of recovering catholyte liquor containing alkali metal chloride, alkali metal hydroxide, and a transition metal compound from an electrolytic cell, recovering the transition metal compound from the cell liquor, and adding a transition metal compound to the catholyte chamber of an electrolytic cell.

In the commercial electrolysis of alkali metal chlorides to yield chlorine, hydrogen, and alkali metal hydroxide, the alkali metal chloride may be sodium chloride or potassium chloride. Most commonly, the alkali metal chloride is sodium chloride and the invention will be described with respect to sodium chloride and sodium hydroxide. However, it is to be understood that the method of this invention is equally useful with potassium chloride brines or, in fact, any process where hydrogen is evolved at the cathode under alkaline conditions, for example, a sodium chlorate cell.

Sodium chloride is fed to the cell as brine. The brine may be saturated brine, containing, for example, from 315 to about 325 grams per liter of sodium chloride. The brine may be an unsaturated brine containing less than about 315 grams per liter of sodium chloride. Or, alternatively, the brine may be a super-saturated brine containing in excess of 325 grams per liter of sodium chloride.

According to the method described herein, the electrolysis is carried out in a diaphragm cell. The diaphragm may, in fact, be an electrolyte permeable diaphragm, for example, as provided by an asbestos diaphragm or a resin treated asbestos diaphragm. Alternatively, the diaphragm may be a microporous diaphragm, for example, provided by a microporous halocarbon. According to a still further exemplification of this invention, the diaphragm may, in fact, be a permionic membrane, substantially impermeable to the passage of electrolyte therethrough but permeable to the flow of ions therethrough.

Whenever the term "permeable barrier" is used herein, it is understood to refer to diaphragms, microporous diaphragms, and permionic membranes, unless the opposite intent appears in context. Such barriers are substantially impermeable to the bulk flow of electrolyte but are permeable, for example, to forced convective flow of electrolyte as in diaphragms and microporous diaphragms, and to the diffusional flow of sodium ion, as in permionic membranes.

Where the diaphragm is an asbestos diaphragm, the diaphragm is most commonly prepared from chrysotile asbestos having fibers in the size range of from about 3T to about 4T, e.g., a mixture of grades 3T and 4T asbestos as measured by the Quebec Asbestos Producers Association standard screen size. The 3T asbestos has a standard screen analysis of 1/16 (2 mesh), 9/16 (4 mesh), 4/16 (10 mesh), and 2/16 (pan). The 4T asbestos has a size distribution of 0/16 (2 mesh), 2/16 (4 mesh), 10/16 (10 mesh), and 4/16 (pan). The numbers within the parentheses refer to the mesh size in meshes per inch.

Permeable diaphragms, prepared from asbestos or from halocarbons, allow the anolyte liquor to percolate through the diaphragm at a high enough rate that the convective flow, i.e., hydraulic flow, through the diaphragm to the catholyte liquor exceeds the electrolyte flow of hydroxyl ion from the catholyte liquor through the diaphragm to the anolyte liquor. In this way, the pH of the anolyte liquor is maintained acid and the formation of chlorate ion within the anolyte liquor is suppressed.

Where an electrolyte permeable asbestos diaphragm is used, the catholyte liquor typically contains from about 10 to about 20 weight percent sodium chloride and from about 8 to about 15 weight percent sodium hydroxide.

Alternatively, a perm-selective membrane may be interposed between the anolyte liquor and the catholyte liquor. When the term "perm-selective" is used herein, it is understood primarily to refer to cation selective permionic membranes which selectively allow the flow of cation therethrough while substantially preventing the flow of anions therethrough. The perm-selective membrane may be provided by a fluorocarbon polymer or a sulfonated fluorocarbon polymer.

Where either an electrolyte permeable diaphragm or perm-selective membrane is used between the anolyte liquor and the catholyte liquor, the cathode reaction has an electrical potential of about 1.21 volt (about 1.45 volt versus a saturated calomel electrode) and, as described above, is reported to be:

$$2H_2O+2e^- \rightarrow H_2+2OH^-, \quad (2)$$

which is the overall reaction for the adsorption step:

$$H_2O+e^- \rightarrow H_{ads}+OH^-, \quad (3)$$

and either of the two alternative hydrogen desorption steps:

$$2H_{ads} \rightarrow H_2, \quad (4)$$

or $$H_{ads}+H_2O+e^- \rightarrow H_2+OH^-. \quad (5)$$

According to the method of this invention, the compound of an electrolytic hydrogen evolution catalyzing transition metal is added to the catholyte liquor while an electrical current is caused to pass from the anode of the electrolytic cell to the cathode of the electrolytic cell. Thereafter, the cathode component of the cell voltage is found to be reduced, for example, from about 1.45 volt S.C.E. before addition to about 1.25 volt S.C.E. after addition. The exact mechanism for attaining this cathode voltage reduction is not clearly understood but it is believed that the transition metal deposits on the cathode while chlorine is being evolved at the anode, thereby maintaining a clean transition metal surface of high surface area on the cathode during electrolysis. The result of the addition of the transition metal compound to the catholyte liquor is to reduce the cell voltage in the cathode voltage.

By the term "electrolytic hydrogen evolution catalyzing transition metal" is meant a transition metal which, when applied to an iron substrate, for example, by electrodeposition, provides a surface having a lower hydrogen evolution voltage than the original metal surface. As will be more fully described hereinafter, such an electrolytic hydrogen evolution catalyzing transition metal coating may be provided by a freshly electrodeposited coating of iron atop a metal substrate.

The electrolytic hydrogen evolution catalyzing transition metals are the metals of groups VI B, VII B, and VIII of the Periodic Table, for example, chromium, molybdenum, tungsten, manganese, technetium, rhenium, iron, cobalt, nickel, ruthenium, rhodium, palladium, osmium, iridium, platinum, and mixtures thereof. Chromium, molybdenum, manganese, technetium, rhenium, iron, cobalt, nickel, ruthenium, rhodium, palladium, osmium, iridium, and platinum, and mixtures thereof are preferred because of their reproducible effect on lowering of hydrogen evolution voltage.

Especially preferred from a practical standpoint are iron, cobalt, nickel, chromium, and manganese. These metals are preferred because the process of addition of the compound of the transition group metal to the catholyte liquor is a semi-continuous process with addition continuing over long periods of electrolysis. The cost of the metal added to the catholyte liquor must be balanced against the savings in power costs. Furthermore, the ease of removal of undeposited metal from the catholyte liquor and the commercial and environmental toleration of the undeposited metal in the catholyte liquor and cathode product must be considered. When these economic considerations are taken into account, chromium, manganese, iron, cobalt, and nickel appear to be the most desirable metals, with iron being particularly preferred. However, the other electrolytic hydrogen evolution catalyzing transition metals disclosed herein above are also satisfactory.

The particular compound of the transition metal that is selected should be substantially resistant to degradation by or reaction with the catholyte liquor. In a further exemplification, the compound of the electrolytic hydrogen evolution catalyzing transition metal should also be substantially resistant to reaction with or degradation by the anolyte liquor in order to allow the compound to be introduced into the electrolytic cell along with the brine feed. However, where the compound is not resistant to the anolyte liquor, the compound may be fed directly into the catholyte chamber of the cell.

Additionally, the compound should be one whose products of decomposition are tolerable in the electrolyte. Where the compound is an inorganic compound, it should be one that does not add any commercially or enrivonmentally undesirable impurity to the electrolyte or the product. For example, the compounds of the transition metals may be chlorides and oxychlorine compounds such as chlorates, chlorites, hypochlorates, hypochlorites, and perchlorates, among others. Additionally, the compound may be a hydroxide. Although other compounds are satisfactory if the acid group thereof can be tolerated as described above, the chlorine compounds and hydroxides are to be preferred.

Alternatively, the compound of the electrolytic hydrogen evolution catalyzing transition metal can be an organic compound, for example, a reaction product of a chelating agent with the metal, having sufficient stability in the electrolyte to avoid depositing an insoluble material around the cell structure. Preferably, the chelating agent should impart some solubility to the metal. Such chelating agents include triethanol amine, alpha amino acids, dicarboxylic acids, beta carbonyls such as 1,3-diketones, 1,2-dicarbonyls, oximes of 1,2-diketones, 1,2-glycols, ethylene diamines, 8-hydroxyquinole, beta keto esters, phthalocyanines, and hydroxy acids, inter alia. The preferred organic compounds from an economic viewpoint are triethanol amine, gluconic acid, citric acid, glycolic acid, and oxalic acid. When such organics are used, a stoichiometric excess of such organic compound may be mixed with the inorganic compound of the transition metal. Thus, $FeCl_2.6H_2O$ may be mixed with gluconic acid and added to the catholyte compartment at a rate of $1 \times 10^{-3}$ to 1 milliequivalent of iron per square centimeter of cathode area per day.

While the compound of the transition metal may be either an organic or an inorganic compound of a transition metal, the preferred compounds are iron chlorides, iron hydroxides, cobalt chlorides, cobalt hydroxides, nickel chlorides, nickel hydroxides, chromium chlorides, chromium hydroxides, manganese chlorides, and manganese hydroxides with ferrous chloride, ferric chloride, ferrous hydroxide, and ferric hydroxide being especially preferred.

The oxidation state of the transition metal does not appear to have any gross effect on the hydrogen evolution potential with, for example, both iron +2 and iron +3 reducing the hydrogen evolution voltage by like amounts.

The rate of addition of the transition metal compound to the catholyte compartment should be sufficient to reduce the cathodic hydrogen evolution voltage. In the case of ferric and ferrous additives, this is generally in an amount sufficient to reduce the voltage by at least 0.1 volt within 60 minutes after the addition and to maintain the voltage at a reduced level, i.e., below about 1.30 volt for an economic period of time after the addition.

The amount of addition of the compound of the transition metal is so low that the addition may be, and preferably is, carried out periodically, that is, every 6 or 12 or 24 or 48 or 72 or 96 hours or even every 7 to 10 days. The amount of addition is generally from about 0.01 gram of the transition metal per square foot to about 10 grams per square foot of cathode area and preferably from about 0.05 gram per square foot to about 5 grams per square foot of cathode area at any one addition. The addition of the transition metal should be frequent enough to maintain the voltage within the desired range and the amount added at any one time should be high enough to provide some voltage reduction. Moreover, the rate of addition, i.e., transition metal added per unit of time and unit of cathode area, must be high enough to perceive some voltage reduction. While a lower threshold amount of the transition metal addition necessary to perceive some voltage reduction has not been determined and even infinitesimally small amounts appear to have some voltage lowering effect, the addition i.e., in terms of transition metal added per unit of cathode area per unit time, should preferably be enough to provide a voltage reduction of about 0.1 volt. In the case of the addition of iron chloride ($FeCl_3.6H_2O$) this is generally about $1 \times 10^{-3}$ milliequivalents per square centimeter of cathode area per day.

Amounts greater than about $10^{-1}$ milliequivalents per square centimeter per day do not appear to be economically justified for iron compound additions, although at higher power costs such addition may be.

The compound of the transition metal may be added to the anolyte liquor, for example, with the brine feed or in a separate feed line or directly to the catholyte. In the case of a diaphragm cell, the feed may be with the brine to the anolyte compartment.

In the case of an electrolyte cell equipped with a permionic membrane, with a microporous diaphragm, or with an asbestos diaphragm, the feed is preferably to the catholyte liquor as by a separate line or a conduit which may be placed within the hydrogen outlet.

While it is believed that most of the transition metal will deposit on the cathode whereby to maintain a fresh, clean, porous transition metal surface on the cathode during electrolysis, some of the transition metal will be solubilized and remain in solution within the catholyte liquor and a portion of the transition metal will be withdrawn with the catholyte. When this occurs, the transition metal may be separated from the alkali metal hydroxide with the alkali metal chloride upon evaporation. Thereafter, the alkali metal chloride and the transition metal compound may be recycled to the anolyte compartment of the cell with the brine feed, for example, as make up.

The method of this invention is useful with various forms of cathodes, as perforated plates, mesh, expanded mesh, wire gauze, and the like, or even imperforate plate, e.g., as in a chlorate cell, or in a diaphragm cell when spaced from the diaphragm. The cathode itself may be fabricated of iron, mold steel, or stainless steel.

The following examples are illustrative of the method of this invention.

EXAMPLE I

A test was conducted to determine the effect of $Fe^{+2}$ addition on the cathode hydrogen evolution potential of a laboratory chlor-alkali diaphragm cell.

The cell had a 5 inch by 7 inch (12.7 centimeters by 17.8 centimeters) ruthenium dioxide-titanium dioxide coated titanium mesh anode spaced from a 5 inch by 7 inch (12.7 centimeters by 17.8 centimeters) etched, expanded iron mesh cathode. An asbestos paper diaphragm was interposed between the anode and the cathode.

An aqueous solution of $FeCl_2.4H_2O$ was added directly to the catholyte compartment of the cell. Electrolysis was carried out at a current density of 190 amperes per square foot (0.20 ampere per square centimeter). The brine feed contained 315 grams per liter of sodium chloride. The catholyte liquor contained 160 grams per liter of sodium chloride and 120 grams per liter of sodium hydroxide.

The iron chloride feed to the cell was through a feed line directly to the catholyte compartment.

The results shown in Table I below were obtained.

TABLE I

| | Amount of Iron Added | | |
|---|---|---|---|
| Days of Operation | Fe (grams/ft$^2$) | $Fe^{++}$ (milliequivalents per cm$^2$ day since last addition) | Cathode Voltage (volts) |
| 1 | 2.00 | $7.71 \times 10^{-2}$ | 1.350 |
| 2 | | | 1.317 |
| 9 | | | 1.376 |
| 12 | 2.00 | $7.09 \times 10^{-3}$ | 1.376 |
| 13 | | | 1.311 |
| 16 | | | 1.331 |
| 19 | 2.00 | $1.10 \times 10^{-2}$ | 1.362 |
| 20 | | | 1.314 |

EXAMPLE II

A test was conducted to determine the effect of $Fe^{+2}$ addition on the cathode hydrogen evolution potential of a laboratory chlor-alkali diaphragm cell.

The cell had a 5 inch by 7 inch (12.7 centimeters by 17.8 centimeters) ruthenium dioxide-titanium dioxide coated titanium mesh anode spaced from a 5 inch by 7 inch (12.7 centimeters by 17.8 centimeters) etched, expanded iron mesh cathode. An asbestos paper diaphragm was interposed between the anode and the cathode.

An aqueous solution of $FeCl_2.4H_2O$ was added directly to the catholyte compartment of the cell. Electrolysis was carried out at a current density of 190 amperes per square foot (0.20 ampere per square centimeter). The brine feed contained 315 grams per liter of sodium chloride. The catholyte liquor contained 160 grams per liter of sodium chloride and 120 grams per liter of sodium hydroxide.

The iron chloride feed to the cell was through a feed line directly to the catholyte compartment.

The results shown in Table II below were obtained.

TABLE II

| Days of Operation | Amount of Iron Added: Fe (grams/ft²) | Amount of Iron Added: $Fe^{++}$ (milliequivalents per cm² day since last addition) | Cathode Voltage (volts) |
|---|---|---|---|
| 1 | | | 1.385 |
| 4 (before) | 1 | $8.9 \times 10^{-3}$ | 1.410 |
| 4 (after) | | | 1.327 |
| 5 (before) | 2 | $7.2 \times 10^{-2}$ | 1.405 |
| 5 (after) | | | 1.320 |
| 12 (before) | 4 | $2 \times 10^{-2}$ | 1.425 |
| 12 (after) | | | 1.310 |
| 13 | | | 1.305 |
| 25 | 2 | $5.5 \times 10^{-3}$ | 1.415 |
| 26 | | | 1.295 |
| 33 | 1 | $4.5 \times 10^{-3}$ | 1.340 |
| 34 | | | 1.290 |

EXAMPLE III

A test was conducted to determine the effect of $Co^{+2}$ addition on the cathode hydrogen evolution potential of a laboratory chlor-alkali diaphragm cell.

The cell had a 5 inch by 7 inch (12.7 centimeters by 17.8 centimeters) ruthenium dioxide-titanium dioxide coated titanium mesh anode spaced from a 5 inch by 7 inch (12.7 centimeters by 17.8 centimeters) etched, expanded iron mesh cathode. An asbestos paper diaphragm was interposed between the anode and the cathode.

An aqueous solution of $CoCl_2.4H_2O$ was added directly to the catholyte compartment of the cell. Electrolysis was carried out at a current density of 190 amperes per square foot (0.20 ampere per square centimeter). The brine feed contained 315 grams per liter of sodium chloride. The catholyte liquor contained 160 grams per liter of sodium chloride and 120 grams per liter of sodium hydroxide.

The cobalt chloride feed to the cell was through a feed line directly to the catholyte compartment.

The results shown in Table III below were obtained.

TABLE III

| Days of Operation | Amount of Cobalt Added: $CoCl_2.4H_2O$ (grams/ft²) | Amount of Cobalt Added: $Co^{++}$ (milliequivalents per cm² day since last addition) | Cathode Voltage (volts) |
|---|---|---|---|
| 1 (before) | 4.0 | $1.4 \times 10^{-1}$ | 1.44 |
| 1 (after) | | | 1.32 |
| 4 | 2.0 | $2.4 \times 10^{-2}$ | 1.350 |
| 5 | 1.4[1] | $5 \times 10^{-2}$ | 1.34 |
| 6 | | | 1.31 |
| 7 | | | 1.34 |

Added to Anolyte

EXAMPLE IV

A test was conducted to determine the effect of $Fe^{+2}$ addition on the cathode hydrogen evolution potential of a laboratory chlor-alkali diaphragm cell.

The cell had a 5 inch by 7 inch (12.7 centimeters by 17.8 centimeters) ruthenium dioxide-titanium dioxide coated titanium mesh anode spaced from a 5 inch by 7 inch (12.7 centimeters by 17.8 centimeters) etched, expanded iron mesh cathode. An asbestos paper diaphragm was interposed between the anode and the cathode.

An aqueous solution of $FeCl_2.4H_2O$ was added directly to the catholyte compartment of the cell. Electrolysis was carried out at a current density of 190 amperes per square foot (0.20 ampere per square centimeter). The brine feed contained 315 grams per liter of sodium chloride. The catholyte liquor contained 160 grams per liter of sodium chloride and 120 grams per liter of sodium hydroxide.

The iron chloride feed to the cell was through a feed line directly to the catholyte compartment.

The results shown in Table IV below were obtained.

TABLE IV

| Days of Operation | Amount of Iron Added (grams/ft²) | Amount of Iron Added (milliequivalents per cm² day since last addition) | Cathode Voltage (volts) Before and after addition |
|---|---|---|---|
| 1 | 4 | $1.54 \times 10^{-1}$ | 1.390 |
| | | | 1.298 |
| 8 | 2 | $9.6 \times 10^{-3}$ | 1.341 |
| | | | 1.295 |
| 11 | 1 | $1.29 \times 10^{-2}$ | 1.310 |
| | | | 1.287 |
| 16 | 0.5 | $3.86 \times 10^{-3}$ | 1.316 |
| | | | 1.304 |
| 21 | 0.5 | $3.86 \times 10^{-3}$ | 1.335 |
| | | | 1.295 |
| 24 | 1 | $1.29 \times 10^{-2}$ | 1.332 |
| | | | 1.290 |

EXAMPLE V

A test was conducted to determine the effect of $Fe^{+2}$ addition on the cathode hydrogen evolution potential of a laboratory chlor-alkali diaphragm cell.

The cell had a 5 inch by 7 inch (12.7 centimeters by 17.8 centimeters) ruthenium dioxide-titanium dioxide coated titanium mesh anode spaced from a 5 inch by 7 inch (12.7 centimeters by 17.8 centimeters) etched, expanded iron mesh cathode. An asbestos paper diaphragm was interposed between the anode and the cathode.

An aqueous solution of $FeCl_2.4H_2O$ was added directly to the catholyte compartment of the cell. Electrolysis was carried out at a current density of 190 amperes per square foot (0.20 ampere per square centimeter). The brine feed contained 315 grams per liter of sodium chloride. The catholyte liquor contained 160 grams per liter of sodium chloride and 120 grams per liter of sodium hydroxide.

The iron chloride feed to the cell was through a feed line directly to the catholyte compartment.

The results shown in Table V below were obtained.

TABLE V

| Days of Operation | Amount of Iron Added (grams/ft²) | Amount of Iron Added (milliequivalents per cm² day since last addition) | Cathode Voltage (volts) Before and after addition |
|---|---|---|---|
| 0 | 2[1] | $7.7 \times 10^{-2}$ | 1.390<br>1.305 |
| 6 | 2[2] | $1.28 \times 10^{-2}$ | 1.340<br>1.240 |
| 12 | 2[2] | $1.28 \times 10^{-2}$ | 1.320<br>1.245 |
| 16 | 2[2] | $1.93 \times 10^{-2}$ | 1.290<br>1.240 |
| 19 | 0.5[2] | $6.43 \times 10^{-3}$ | 1.280<br>1.250 |
| 21 | 0.25[3] | $3.22 \times 10^{-2}$ | 1.270<br>1.257 |
| 22 | 0.25[3] | $6.43 \times 10^{-3}$ | 1.270<br>1.265 |
| 26 | 0.25[4] | $1.61 \times 10^{-3}$ | 1.283<br>1.245 |
| 28 | 0.25[5] | $3.22 \times 10^{-3}$ | 1.263 |
| 29 | 0.25[5,8] | $6.43 \times 10^{-3}$ | 1.272<br>1.272 |
| 30 | 0.25[5,8] | $6.43 \times 10^{-3}$ | 1.283<br>1.275 |
| 33 | 0.25[6,8] | $2.14 \times 10^{-3}$ | 1.294 |
| 34 | 0.50[3,8] | $1.28 \times 10^{-2}$ | 1.295 |
| 35 | 0.50[7,8] | $1.28 \times 10^{-2}$ | 1.310<br>1.250 |

[1]Added as $FeCl_2.Fe(OH)_2$
[2]Added as $FeCl_2$ in triethanol amine
[3]Added as $FeCl_3$ in gluconic acid
[4]Added as $FeCl_3$ in triethanol amine
[5]Added as $FeCl_3$ in gluconic and citric acid
[6]Added as $FeCl_3$ in gluconic and oxalic acid
[7]Added as $FeCl_3$ in oxalic acid and triethanol amine
[8]Added through anolyte

EXAMPLE VI

A test was conducted to determine the effect of $Fe^{+3}$ addition on the cathode hydrogen evolution potential of a laboratory chlor-alkali diaphragm cell.

The cell had a 5 inch by 7 inch (12.7 centimeters by 17.8 centimeters) ruthenium dioxide-titanium dioxide coated titanium mesh anode spaced from a 5 inch by 7 inch (12.7 centimeters by 17.8 centimeters) etched, nickel plated, expanded iron mesh cathode. Asbestos and Allied Chemical Co. HALAR® poly(chlorotrifluoroethylene) were deposited on the cathode and the cathode was heated to 255° C. for 60 minutes whereby to provide a diaphragm.

An aqueous solution prepared in the proportion of 2.41 grams of $FeCl_3.6H_2O$ and 3.50 grams of triethanol amine in 200 milliliters of water was added dropwise to the catholyte compartment of the cell at the times shown in Table VI. Electrolysis was carried out at a current density of 190 amperes per square foot (0.2 ampere per square centimeter). The brine feed contained 315 grams per liter of sodium chloride. The catholyte liquor contained 160 grams per liter of sodium chloride and 120 grams per liter of sodium hydroxide.

The iron chloride feed to the cell was through a feed line directly to the catholyte compartment.

The results shown in Table VI below were obtained.

TABLE VI

| Days of Operation | Amount of Iron Added (grams/ft²) | Amount of Iron Added (milli-equivalents per cm² day since last addition) | Cathode Voltage (volts) Before and after addition |
|---|---|---|---|
| 1 | | | 1.368 |
| 2 | 1 | $1.29 \times 10^{-2}$ | 1.375 |
| 3 | 2 | $5.14 \times 10^{-2}$ | 1.318 |

TABLE VI-continued

| Days of Operation | Amount of Iron Added (grams/ft²) | Amount of Iron Added (milli-equivalents per cm² day since last addition) | Cathode Voltage (volts) Before and after addition |
|---|---|---|---|
| | | | 1.240 |
| 4 | 2 | $5.14 \times 10^{-2}$ [1] | 1.284<br>1.252 |
| 7 | 2 | $1.71 \times 10^{-2}$ [1] | 1.315<br>1.252 |
| 8 | 2 | $5.14 \times 10^{-2}$ | 1.285<br>1.235 |
| 9 | 0.5 | $1.29 \times 10^{-2}$ | 1.272<br>1.235 |
| 10 | 0.25 | $6.4 \times 10^{-3}$ | 1.272<br>1.240 |
| 11 | 0.25 | $6.4 \times 10^{-3}$ | 1.275<br>1.245 |
| 14 | 0.12 | $1.1 \times 10^{-3}$ | 1.293<br>1.247 |
| 15 | 0.12 | $3.2 \times 10^{-3}$ | 1.277<br>1.256 |
| 16 | 0.06 | $1.61 \times 10^{-3}$ | 1.286<br>1.255 |
| 18 | 0.25 | $3.2 \times 10^{-3}$ | 1.290 |
| 22 | 0.25 | $1.61 \times 10^{-3}$ | 1.305<br>1.255 |
| 23 | 0.50 | $1.29 \times 10^{-2}$ | 1.275<br>1.250 |
| 24 | 2.00 | $5.14 \times 10^{-2}$ | 1.275<br>1.235 |
| 25 | 0.06 | $1.61 \times 10^{-3}$ | 1.262<br>1.248 |
| 28 | | | 1.281 |

[1]Added a solution of 2.41 grams of $FeCl_3.6H_2O$, 0.88 grams of gluconic acid, and 0.67 gram of triethanol amine to catholyte dropwise.

While the invention has been described with respect to certain exemplifications and embodiments thereof, the scope is not to be so limited except as in the claims appended hereto.

We claim:

1. In the method of electrolyzing sodium chloride brine in an electrolytic cell by passing an electrical current from an anode of the electrolytic cell, in an aqueous sodium chloride anolyte liquor, through a permeable barrier to an iron cathode of the electrolytic cell, in an aqueous alkaline sodium hydroxide catholyte liquor, evolving chlorine at the anode, and evolving hydrogen at the cathode, the improvement comprising adding a compound of an electrolytic hydrogen evolution catalyzing transition metal to the aqueous sodium hydroxide catholyte liquor of the electrolytic cell while passing an electrical current from the anode to the cathode.

2. The method of claim 1 wherein the transition metal is chosen from the group consisting of the transition metals of Groups VI B, VII B, and VIII, and mixtures thereof.

3. The method of claim 2 wherein the transition metal is chosen from the group consisting of chromium, molybdenum, manganese, technetium, rhenium, iron, cobalt, nickel, ruthenium, rhodium, palladium, osmium, iridium, platinum and mixtures thereof.

4. The method of claim 1 wherein the compound of the transition metal is an inorganic compound.

5. The method of claim 4 wherein the compound of the transition metal is chosen from the group consisting of chlorine compounds and hydroxides.

6. The method of claim 1 wherein the compound of the transition metal is an organo metallic compound that is resistant to acidified brine.

7. The method of claim 1 comprising adding the compound of the transition metal to the catholyte liquor at the rate of at least $10^{-4}$ milliequivalents of metal per square centimeter of cathode area per day.

8. The method of claim 1 comprising recovering a catholyte liquor comprising sodium chloride, sodium hydroxide, and the transition metal compound, recovering transition metal compound from the cell liquor, and adding the transition metal compound to the catholyte chamber of an electrolytic cell.

9. The method of claim 1 comprising adding the compound of the electrolytic hydrogen evolution catalyzing transition metal directly to the catholyte liquor while passing an electrical current from the anode to the cathode.

10. In a method of operating an electrolytic cell having an anode in an anolyte chamber, an iron cathode in a catholyte chamber, and a permeable barrier therebetween, said anolyte chamber containing aqueous sodium chloride anolyte liquor and said catholyte chamber containing aqueous alkaline sodium hydroxide cell liquor, which method comprises imposing an electrical potential across said cell thereby causing an electrical current to pass from the anode to the cathode, and evolving chlorine at the anode and hydrogen at the cathode, the improvement comprising adding a compound of a transition metal to the aqueous sodium hydroxide catholyte liquor of the electrolytic cell whereby to deposit the transition metal on the cathode while evolving chlorine at the anode.

11. The method of claim 10 wherein the transition metal is chosen from the group consisting of the transition metals of Groups VI B, VII B, and VIII, and mixtures thereof.

12. The method of claim 11 wherein the transition metal is chosen from the group consisting of chromium, molybdenum, manganese, technetium, rhenium, iron, cobalt, nickel, ruthenium, rhodium, palladium, osmium, iridium, platinum, and mixtures thereof.

13. The method of claim 10 wherein the compound of the transition metal is an inorganic compound.

14. The method of claim 13 wherein the compound of the transition metal is chosen from the group consisting of chlorine compounds and hydroxides.

15. The method of claim 10 comprising adding the compound of the transition metal to the catholyte liquor at the rate of at least $10^{-4}$ milliequivalents of metal per square centimeter of cathode area per day.

16. The method of claim 10 comprising adding the compound of the transition metal directly to the catholyte liquor while passing an electrical current from the anode to the cathode.

17. In the method of electrolyzing alkali metal chloride brine in an electrolytic cell by passing an electrical current from an anode of the electrolytic cell, in an aqueous alkali metal chloride anolyte liquor, through a permeable barrier to an iron cathode of the electrolytic cell, in an aqueous catholyte liquor, evolving chlorine at the anode, and evolving hydrogen at the cathode, the improvement comprising adding a compound of an electrolytic hydrogen evolution catalyzing transition metal to the aqueous alkali metal hydroxide catholyte liquor of the electrolytic cell while passing an electrical current from the anode thereof to the cathode thereof.

18. The method of claim 17 wherein the transition metal is chosen from the group consisting of the transition metals of Groups VI B, VII B, and VIII, and mixtures thereof.

19. The method of claim 18 wherein the transition metal is chosen from the group consisting of chromium, molybdenum, manganese, technetium, rhenium, iron, cobalt, nickel, ruthenium, rhodium, palladium, osmium, iridium, platinum and mixtures thereof.

20. The method of claim 17 wherein the compound of the transition metal is an inorganic compound.

21. The method of claim 20 wherein the compound of the transition metal is chosen from the group consisting of chlorine compounds and hydroxides.

22. The method of claim 17 wherein the compound of the transition metal is an organo metallic compound that is resistant to acidified brine.

23. The method of claim 17 comprising adding the compound of the transition metal to the catholyte liquor at the rate of at least $10^{-4}$ milliequivalents of metal per square centimeter of cathode area per day.

24. The method of claim 17 comprising recovering a catholyte liquor comprising sodium cloride, sodium hydroxide, and the transition metal compound, recovering transition metal compound from the cell liquor, and adding the transition metal compound to the catholyte chamber of an electrolytic cell.

* * * * *